US011170739B2

(12) United States Patent
Li et al.

(10) Patent No.: US 11,170,739 B2
(45) Date of Patent: Nov. 9, 2021

(54) DISPLAY OPTIMIZATION METHOD AND APPARATUS, DISPLAY DRIVING METHOD AND APPARATUS, DISPLAY APPARATUS, AND STORAGE MEDIUM

(71) Applicants: ORDOS YUANSHENG OPTOELECTRONICS CO., LTD., Inner Mongolia (CN); BOE TECHNOLOGY GROUP CO., LTD., Beijing (CN)

(72) Inventors: Wei Li, Beijing (CN); Pan Guo, Beijing (CN); Yulin Zhang, Beijing (CN)

(73) Assignees: ORDOS YUANSHENG OPTOELECTRONICS CO., LTD., Inner Mongolia (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/644,995

(22) PCT Filed: Jul. 19, 2019

(86) PCT No.: PCT/CN2019/096853
§ 371 (c)(1),
(2) Date: Mar. 6, 2020

(87) PCT Pub. No.: WO2020/020077
PCT Pub. Date: Jan. 30, 2020

(65) Prior Publication Data

US 2020/0202817 A1 Jun. 25, 2020

(30) Foreign Application Priority Data

Jul. 23, 2018 (CN) ..... 201810813984.3

(51) Int. Cl.
*G09G 5/30* (2006.01)
*G09G 5/40* (2006.01)

(52) U.S. Cl.
CPC ..... *G09G 5/30* (2013.01); *G09G 5/40* (2013.01); *G09G 2310/0232* (2013.01); *G09G 2320/06* (2013.01); *G09G 2340/0442* (2013.01)

(58) Field of Classification Search
CPC ..... G09G 2310/0232; G09G 2320/06; G09G 2320/0673; G09G 2340/0442; G09G 3/20; G09G 3/2007; G09G 5/30; G09G 5/40
See application file for complete search history.

(56) References Cited

U.S. PATENT DOCUMENTS 10,325,545 B2 6/2019 Zheng et al.
10,388,680 B2 8/2019 Zheng et al.
(Continued)

FOREIGN PATENT DOCUMENTS

CN 106707606 5/2017
CN 107526201 12/2017
(Continued)

*Primary Examiner* — Afroza Chowdhury
(74) *Attorney, Agent, or Firm* — Leason Ellis LLP

(57) ABSTRACT

A display optimization and display driving method and apparatus, display apparatus, and storage medium are disclosed. The display optimization method includes: selecting an irregular-shaped edge of a display panel, calculating an area ratio of an area of a display region of a pixel unit passed by the irregular-shaped edge and an area of the pixel unit; and determining a grayscale parameter of the pixel unit according to the area ratio.

16 Claims, 6 Drawing Sheets

(56) References Cited

U.S. PATENT DOCUMENTS

| | | | | |
|---|---|---|---|---|
| 10,504,400 | B2 | 12/2019 | Wang et al. | |
| 10,522,587 | B2 | 12/2019 | Zeng et al. | |
| 2015/0221248 | A1* | 8/2015 | Kim | G09G 3/2044 345/204 |
| 2018/0074353 | A1 | 3/2018 | Hirata et al. | |
| 2018/0130397 | A1* | 5/2018 | Zheng | G09G 3/207 |
| 2018/0151612 | A1* | 5/2018 | Zheng | G09G 3/20 |
| 2019/0088709 | A1* | 3/2019 | Zeng | H01L 27/1218 |
| 2020/0035141 | A1 | 1/2020 | Yang et al. | |

FOREIGN PATENT DOCUMENTS

| | | |
|---|---|---|
| CN | 107577078 | 1/2018 |
| CN | 107610594 | 1/2018 |
| CN | 107644410 | 1/2018 |
| CN | 108615499 | 10/2018 |
| CN | 108682308 | 10/2018 |

* cited by examiner

DISPLAY OPTIMIZATION METHOD AND APPARATUS, DISPLAY DRIVING METHOD AND APPARATUS, DISPLAY APPARATUS, AND STORAGE MEDIUM

CROSS-REFERENCE TO RELATED PATENT APPLICATIONS

This application is a U.S. National Stage Application under 35 U.S.C. § 371 of International Patent Application No. PCT/CN2019/096853, filed Jul. 17, 2019, which claims the benefit of Chinese Patent Application No. 201810813984.3 filed on Jul. 23, 2018 and entitled "Display Optimization Method and Apparatus, Display Driving Method and Apparatus, Display Apparatus, and Storage Medium", both of which are incorporated by reference herein in their entireties. The International Application was published on Jan. 30, 2020, as International Publication No. WO 2020/020077 A1.

TECHNICAL FIELD

Embodiments of the present disclosure relate to a display optimization method and an apparatus therefor, a display driving method and an apparatus therefor, a display apparatus, and a storage medium.

BACKGROUND

With the development of the electronic consumer market, the shape of the display screen of electronic products is no longer limited to conventional regular rectangles, but irregular-shaped display screens, such as circular, octagonal or rounded rectangle display screens, or the currently popular "bangs" screen and so on, are increasingly in use. At present, when preparing an irregular-shaped display panel, it is necessary to set the display parameters of the pixel units one by one in the irregular-shaped transition portion (the irregular-shaped edge portion) between the straight edge portions. At present, a main setting method is manual setting, but this manual setting method easily causes the transition of the overall display effect to be not smooth, slightly burr, and the like. In addition, the manual setting method also makes the obtained display effect of the display panel greatly affected by the subjective feelings of the person who sets it, resulting in uneven product quality.

SUMMARY

At least one embodiment of the present disclosure provides a display optimization method comprising: selecting an irregular-shaped edge of a display panel, and calculating an area ratio of an area of a display region of a pixel unit passed by the irregular-shaped edge and an area of the pixel unit; and determining a grayscale parameter of the pixel unit according to the area ratio.

For example, in the display optimization method provided by an embodiment of the present disclosure, the irregular-shaped edge comprises an arc-shaped corner edge or an edge, with a corner formed by straight-lines, of the display panel.

For example, in the display optimization method provided by an embodiment of the present disclosure, calculating the area ratio of the area of the display region of the pixel unit passed by the irregular-shaped edge to the area of the pixel unit comprises: connecting two intersections between the irregular-shaped edge and the pixel unit by using a straight line, and dividing the pixel unit into the display region and a non-display region by using the straight line.

For example, in the display optimization method provided by an embodiment of the present disclosure, determining the grayscale parameter of the pixel unit according to the area ratio comprises: obtaining the grayscale parameter from the area ratio according to a predetermined gamma function relationship between a predetermined grayscale value and the area ratio.

For example, in the display optimization method provided by an embodiment of the present disclosure, obtaining the grayscale parameter from the area ratio according to the predetermined gamma function relationship between the predetermined grayscale value and the area ratio comprises: dividing a range of grayscale values into multiple intervals, each interval having a corresponding eigenvalue; obtaining a first grayscale value from the area ratio according to the gamma function relationship, determining a first interval in which the first grayscale value falls, and selecting an eigenvalue of the first interval to modify the first grayscale value, and using a modified first grayscale value as the grayscale parameter.

For example, the display optimization method provided by an embodiment of the present disclosure further comprising: obtaining a modified area ratio from the modified first grayscale value according to the gamma function relationship, wherein the modified area ratio is used to adjust the area of the display region of the pixel unit.

For example, the display optimization method provided by an embodiment of the present disclosure further comprising: storing the grayscale parameter for accessing when the display panel performs a display operation.

For example, in the display optimization method provided by an embodiment of the present disclosure, calculating the area ratio of the area of the display region of the pixel unit passed by the irregular-shaped edge to the area of the pixel unit comprises: when an endpoint of the irregular-shaped edge is located inside the pixel unit, making an extension line of the irregular-shaped edge through the endpoint, the extension line having a first intersection with an edge of the pixel unit on one side of the irregular-shaped edge, and having a second intersection with an edge of the pixel unit on the other side of the irregular-shaped edge; and determining the display region and a non-display region of the pixel unit according to a connection line between the first intersection point and the second intersection point on the extension line.

For example, in the display optimization method provided by an embodiment of the present disclosure, the extension line is tangent to the irregular-shaped edge, and a tangent point is the endpoint.

At least one embodiment of the present disclosure provides a display optimization apparatus comprising: a calculation module configured to calculate an area ratio between an area of a display region of a pixel unit passed by an irregular-shaped edge and an area of the pixel unit; and a determination module configured to determine a grayscale parameter of the pixel unit according to the area ratio.

At least one embodiment of the present disclosure provides a display driving method comprising: determining a display grayscale value displayed by a pixel unit passed by an irregular-shaped edge according to a predetermined display grayscale signal and a previously stored grayscale parameter, so that the pixel unit displays according to the display grayscale value, wherein the grayscale parameter is determined according to any of the above display optimization methods.

For example, in the display driving method provided by an embodiment of the present disclosure, the display grayscale value is obtained by calculating the predetermined display grayscale signal and the grayscale parameter.

At least one embodiment of the present disclosure provides a display optimization apparatus comprising: a processor; and a memory on which computer-executable instructions are stored, wherein the computer-executable instructions, when executed by the processor, cause the processor to perform any of the above display optimization methods.

At least one embodiment of the present disclosure provides a display driving apparatus comprising: a processor; a memory on which computer-executable instructions are stored, wherein the computer-executable instructions, when executed by the processor, cause the processor to perform any of the above display driving methods.

At least one embodiment of the present disclosure provides a display apparatus comprising a display panel and the above display driving apparatus, wherein the display panel has an irregular-shaped edge, and the display driving apparatus is coupled to the display panel and is configured to drive the display panel.

At least one embodiment of the present disclosure provides a storage medium storing computer-executable instructions that, when executed by a computer, cause the computer to perform any of the above display optimization methods, or perform any of the above display driving methods.

BRIEF DESCRIPTION OF THE DRAWINGS

The present disclosure will become more fully understood from the detailed description given hereinafter and the accompanying drawings which are given by way of illustration only, and thus are not limitative of the present disclosure and wherein.

DETAILED DESCRIPTION

In order to make objects, technical details and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

At present, in order to achieve better display effects, many electronic products continuously adopt increased sizes of display screens, but due to the setting layout of other functional elements, the display screen needs to be designed as an irregular-shaped screen.

Figure 1:
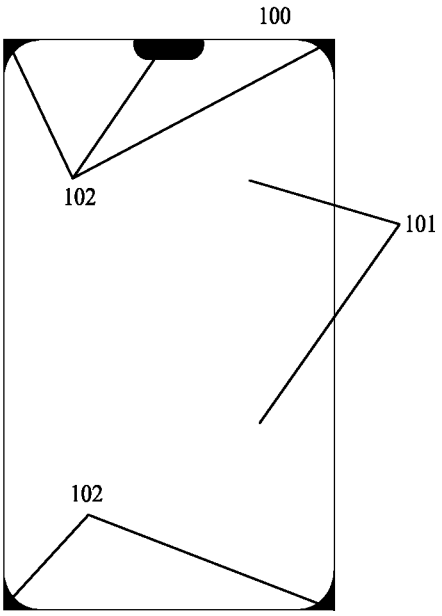
FIG. 1 is a schematic diagram of a display panel with an irregular-shaped edge provided by the present disclosure.

FIG. 1 is a schematic diagram of a display panel 100 with irregular-shaped edges. The overall outline of the display panel is still a regular rectangle, including a display region 101 and a non-display region 102. The non-display region 102 includes four rounded corner areas and a U-shaped groove area (a "bangs" area) corresponding to the display region 101. The display panel may be a liquid crystal display (LCD) panel, or a light emitting diode (LED) display panel, such as an organic light emitting diode (OLED) display panel, a quantum dot light emitting diode (QLED) display panel, or an inorganic light emitting diode display panel. The overall shape of the display panel is in a regular rectangle, and its aspect ratio may be, for example, 18:9, 16:9, etc., or other ratios. The display region of the display panel with irregular-shaped edges may also be in other shapes, such as a circle, an octagon, and the like, which are not specifically limited in the embodiments of the present disclosure.

For example, in order to prepare the irregular-shaped display panel shown in FIG. 1, different methods are adopted according to different types of the display panel. For example, for an OLED or QLED display panel, an evaporation mask corresponding to the above-mentioned irregular-shaped display region may be used to prepare a corresponding pixel area, and an appropriate black matrix (a light-shielding layer) may be used to block the non-display portions of pixel units. For example, for an LCD display panel, a frame sealant may be coated corresponding to the above-mentioned irregular-shaped display region, and an appropriate black matrix may be used to block the non-display portions of pixel units. After the above-mentioned display panel is obtained, the original display panel can be cut to remove parts that are not involved in the display function at all during operation to be of an irregular shape, such as cutting out the "bangs" area that is mentioned above, so that the display panel can accommodate apparatuses such as a camera, a distance sensor, etc. after assembly into a final product. The cutting method include, for example, wheel cutting, laser cutting, etc., and laser cutting includes, for example, nanosecond cutting and picosecond cutting using different types of lasers (for example, $CO_2$ laser, etc.), which are not specifically limited in the embodiments of the present disclosure.

As can be seen from FIG. 1, the edge between the display region 101 and the non-display region 102 of the obtained display panel is no longer only the long or wide edge of the regular rectangle, but includes an irregular-shaped edge. Although the pixel units passed by the irregular-shaped edge are retained completely, part of them are blocked by the black matrix that defines the irregular-shaped edge, that is, the irregular-shaped edge passes through these pixel units. The part of the pixel units that are not blocked by the black matrix can continue to participate in the display operation of the display panel, while the part of the pixel units blocked by the black matrix will not continue to participate in the display operation of the display panel.

In order to obtain a good display effect, for example, to obtain a better edge display effect, it is necessary to redesign and adjust the display parameters of these pixel units passed by the irregular-shaped edge. Generally speaking, a pixel point, i.e., a pixel unit, seen by the human eye on a display screen (e.g., an LCD screen or an OLED screen), is composed of three sub-pixels of the three primary colors of red, green, and blue (RGB). According to display data (digital signals), each sub-pixel can show different brightness levels. For each sub-pixel, grayscales represent different brightness levels from the darkest to the brightest. The change levels of each color of the three primary colors are obtained by dividing continuously from solid color (e.g., pure red) to black to obtain the grayscales of this color, and are represented with numbers (the display data), and this is the most common color display principle. If there are more levels of the grayscale, the display effect that a display panel can present is more delicate. Therefore, the setting of the grayscale value is the basis for determining display effect.

At present, the grayscales of the pixel units passed by the irregular-shaped edge in the irregular screen are set manually, that is, the grayscale value of each pixel unit passed by the irregular-shaped edge is manually assigned, and then the overall display effect, especially the edge transition effect, is observed with reference to a display picture. The reference picture may be a white picture, i.e., a picture that is displayed when the RGB sub-pixels all emit light at the grayscale of 255. It is generally intended that the visual effects of the display region and the non-display region of the display panel can have natural transition therebetween. If there is any edge pixel unit with an irregular display effect, the grayscale value of the corresponding pixel unit is reassigned. Because there are a large number of pixel units passed by the irregular-shaped edge, the manual setting method incurs a large workload. In addition, due to the difference of human eyes, the display effect of the irregular-shaped edge is greatly affected by the subjective factors of the operator, which will in turn affect the overall display effect of the irregular-shaped screen.

At least one embodiment of the present disclosure provides a display optimization method, which includes selecting an irregular-shaped edge of a display panel, and calculating an area ratio of an area of a display region of a pixel unit to an area of the pixel unit passed by the irregular-shaped edge; and determining a grayscale parameter of the pixel unit according to the area ratio. Correspondingly, at least one embodiment of the present disclosure also provides a display driving method and apparatus, a display optimization method and apparatus, a display driving apparatus, a display apparatus, and a storage medium.

The display optimization method and apparatus, the display driving method and apparatus, the display apparatus and the storage medium provided by the embodiments of the present disclosure can reasonably set the grayscale parameters of a display panel with an irregular-shaped edge to optimize the display effect thereof.

The embodiments of the present disclosure will be described in detail below with reference to the drawings.

Figure 2:
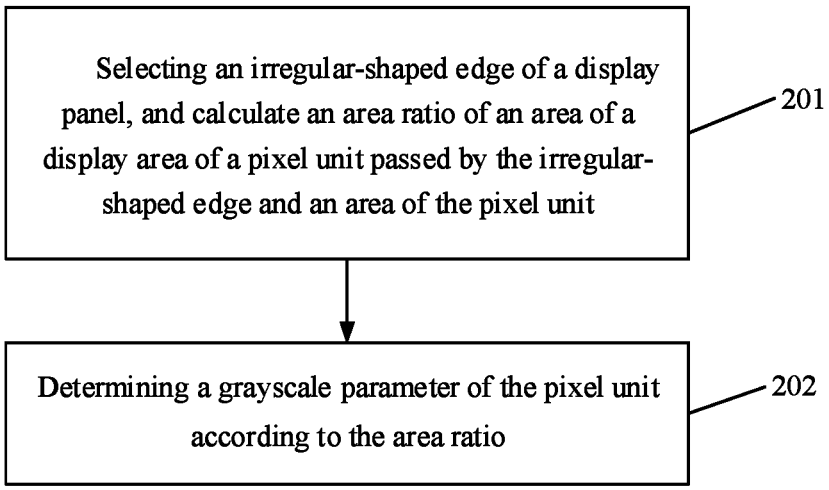
FIG. 2 is a schematic flowchart of a display optimization method provided by an embodiment of the present disclosure.

An embodiment of the present disclosure provides a display optimization method. The method is applicable to, for example, a display panel including an irregular-shaped edge as shown in FIG. 1. A schematic flowchart of the method is shown in FIG. 2, and the method includes the following steps S201 to S202:

In step S201, an irregular-shaped edge of a display panel is selected, and an area ratio of an area of a display region of a pixel unit to an area of the pixel unit is calculated.

In step S202, a grayscale parameter of the pixel unit is determined according to the area ratio.

For example, in the embodiment of the present disclosure, the irregular-shaped edge is a boundary line of an irregular rectangular edge between a display region and a non-display region of the display panel. For example, the irregular-shaped edge includes an irregular-shaped edge formed by four rounded corners of a rectangular display panel, and may also include an irregular-shaped edge formed by cutting out a specific-shaped groove on one side of the rectangular display panel. A part of the pixel unit through which the irregular-shaped edge of the display panel passes is blocked by the black matrix, but the rest part of the pixel unit still participates in a display operation, and the rest belongs to the display region of the pixel unit. Therefore, it is necessary to calculate the area of the display region of the pixel unit, and then calculate the area ratio of this area to the overall area of the pixel unit. The area ratio is then used to determine the grayscale parameter of the pixel unit. A specific exemplary determination method will be described below with reference to FIG. 7.

Figure 3:
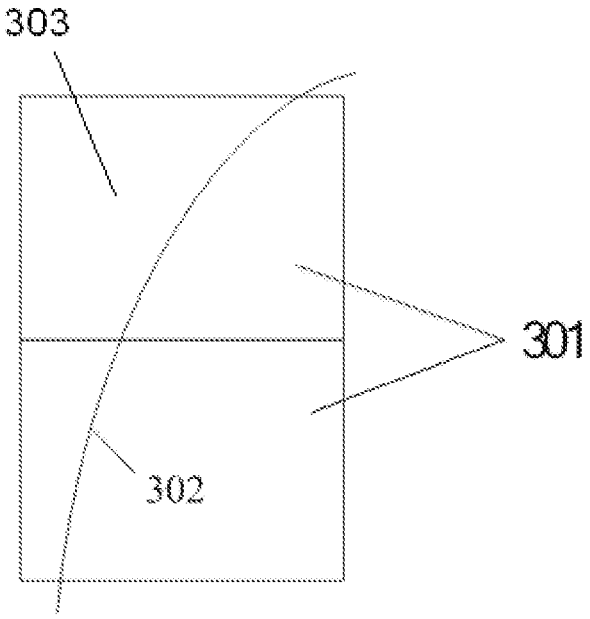
FIG. 3 is a schematic diagram of an arc-shaped corner edge intersecting with pixel units provided by an example of an embodiment of the present disclosure.

For example, FIG. 3 shows a schematic diagram of an arc-shaped corner edge intersecting with a pixel unit provided by an example in an embodiment of the present disclosure, including a pixel unit 301 and an irregular-shaped edge 302, and each pixel unit 301 is in a rectangle shape. The irregular-shaped edge 302 in FIG. 3 is an arc-shaped corner edge, which may be a part of the irregular-shaped edge generated by converting four straight corners of the original rectangular display panel into four rounded corners, and may also be a part of the edge of a specific-shaped groove (e.g., a U-shaped groove) formed on one side of the original display panel. As can be seen from FIG. 3, the irregular-shaped edge divides each pixel unit into two parts, one part is the display region, which participates in normal display, and the other part is the non-display region, which is blocked by the black matrix 303 or the like.

Figure 4:
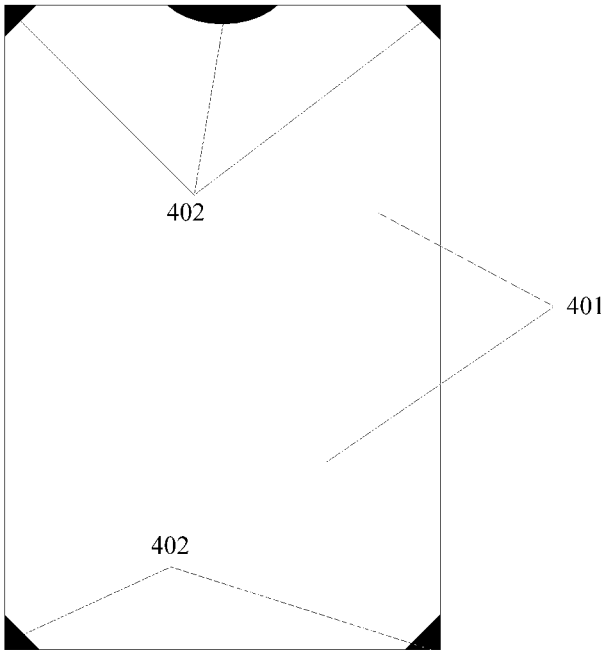
FIG. 4 is a schematic diagram of an irregular-shaped display panel provided by another example of an embodiment of the present disclosure.
Figure 5:
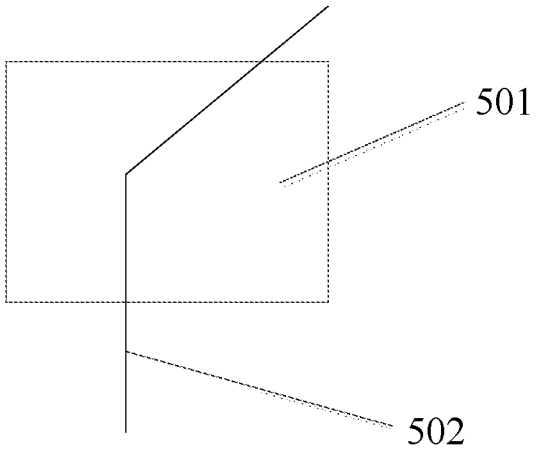
FIG. 5 is a schematic diagram of an irregular-shaped edge, with a corner formed by straight-lines, intersecting a pixel unit provided by another example of an embodiment of the present disclosure.

For example, FIG. 4 shows a schematic diagram of an irregular-shaped display panel provided by another example in an embodiment of the present disclosure, including a display region 401 and a non-display region 402. The irregular-shaped edges of the four corners of the display panel in FIG. 4 are formed by an intersection of straight-lines. Such irregular-shaped edges are convenient for manufacturing, and make the irregular-shaped display panel have better anti-falling performance, and also beneficial to processes such as circuit wiring. FIG. 5 shows a schematic diagram of an irregular-shaped edge, with a corner formed by straight-lines, intersecting with a pixel unit obtained by enlarging a part of the irregular-shaped edge, including a pixel unit 501 and an irregular-shaped edge 502, and each pixel unit 501 is in a rectangle shape. Similarly, the irregular-shaped edge 502 divides the pixel unit 501 into a display region and a non-display region.

Figure 6A:
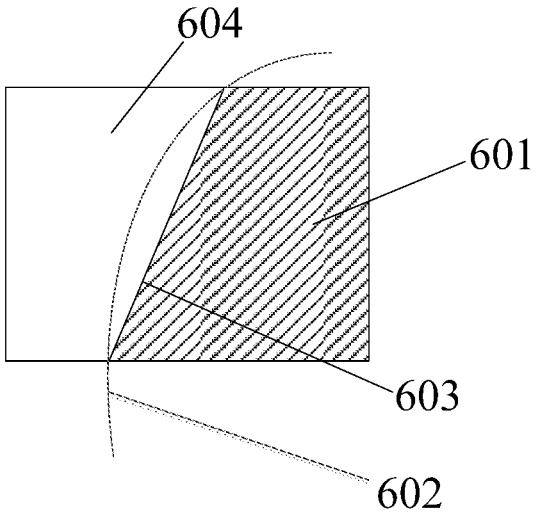
FIG. 6A is a schematic diagram of dividing a pixel unit provided by another example of an embodiment of the present disclosure.

For example, in order to make the process of calculating the display region easier, the display region of the pixel unit passed by the irregular-shaped edge may be re-divided. For example, when the irregular-shaped edge passing through a pixel unit is an arc, two intersections between the irregular-shaped edge and the pixel unit may be connected by a straight line, and the pixel unit is divided into a display region and a non-display region by the straight line. A schematic diagram of dividing the pixel unit is shown in FIG. 6A. An irregular-shaped edge 602 passes through a pixel unit to obtain two intersections, and the two intersections are connected by a straight line 603, which divides the pixel unit into a display region 601 and a non-display region 604, thereby reducing the amount of calculation and speeding up the calculation without substantially affecting the calculation result. The embodiments of the present disclosure are not limited thereto, and the determination of the display region and the non-display region can depend on specific circumstances.

Figure 6B:
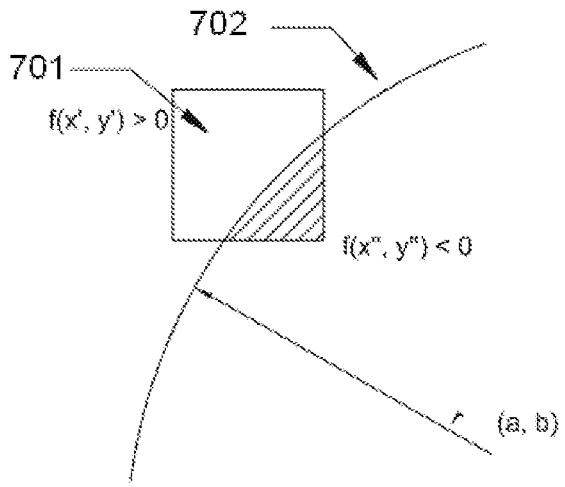
FIG. 6B is a schematic diagram of a method for determining whether a pixel unit intersects with an arc-shaped edge in an embodiment of the present disclosure.

FIG. 6B is a schematic diagram of a method for determining whether a pixel unit intersects an arc-shaped edge in an embodiment of the present disclosure. An irregular-shaped edge 702 is a part of the arc, the coordinate of the center of the circle is (a, b), and the radius of the circle is r. Then the equation of the circle is expressed as: $f(x, y)=(x+a)2+(y+b)2-r2$. The coordinates of the four endpoints of the pixel unit 701 are respectively substituted into the equation of the circle. When the calculation results of substituting the four endpoints of the pixel unit into the above equation are all $f(x, y)<0$, or when the calculation result of substituting one of the four endpoints into the above equation is $f(x, y)<0$, and the calculation results of substituting the remaining three endpoints into the above equation are all $f(x, y)<0$ or $f(x, y)>0$, it indicates that the irregular-shaped edge does not pass through the pixel unit 701. When the coordinates of the four endpoints of the pixel unit are substituted into the above equation of the circle, the calculation results corresponding to the coordinates of at least one endpoint are $f(x, y)>0$, and the calculation results corresponding to the coordinates of at least one endpoint are $f(x, y)<0$, it indicates that the pixel unit 701 has two intersections with the irregular-shaped edge 702, that is, the irregular-shaped edge 702 passes through the pixel unit 701. Furthermore, the pixel unit 701 is divided into a display region and a non-display region by the irregular-shaped edge 702. The document exported from a CAD software can be read by using a calculation software such as MATLAB to obtain the position information of the intersections between the pixel unit and the irregular edge, thereby calculating the area of the display region of the pixel unit and the area of the pixel unit, and then calculating the area ratio.

For example, after the area ratio is calculated above, the grayscale parameter of the pixel unit can be determined according to the area ratio.

In an example, it is assumed that there is a gamma function relationship between the grayscale value and the area ratio, and thus the grayscale parameter of a pixel unit can be determined according to the gamma function relationship. The sensitivity of the human eye to changes in the brightness of the display picture is related to the brightness of the display picture, and the human eye is most sensitive to changes in the picture when the brightness of the picture is low. In order to convert the relationship between the grayscale and the brightness perceived by the human eye into a linear relationship, it is necessary to fit, according to the relationship between the display data voltage applied to the pixel unit and the light intensity curve of the pixel unit, a grayscale-light intensity curve, which is an exponential function curve, i.e., a gamma function curve, and the index of this function is the gamma value. For cathode ray tube (CRT) displays or OLED display panels, light intensity refers to the light-emitting intensity of pixel units; for LCD display panels, light intensity corresponds to the product of the transmittance of pixel units and backlight intensity, and the backlight intensity is usually fixed, so that the light intensity can be replaced by the transmittance to obtain the gamma curve. For the pixel unit passed by the irregular-shaped edge, the light intensity may be replaced by the area ratio of the area of the display region to the area of the pixel unit.

Figure 7:
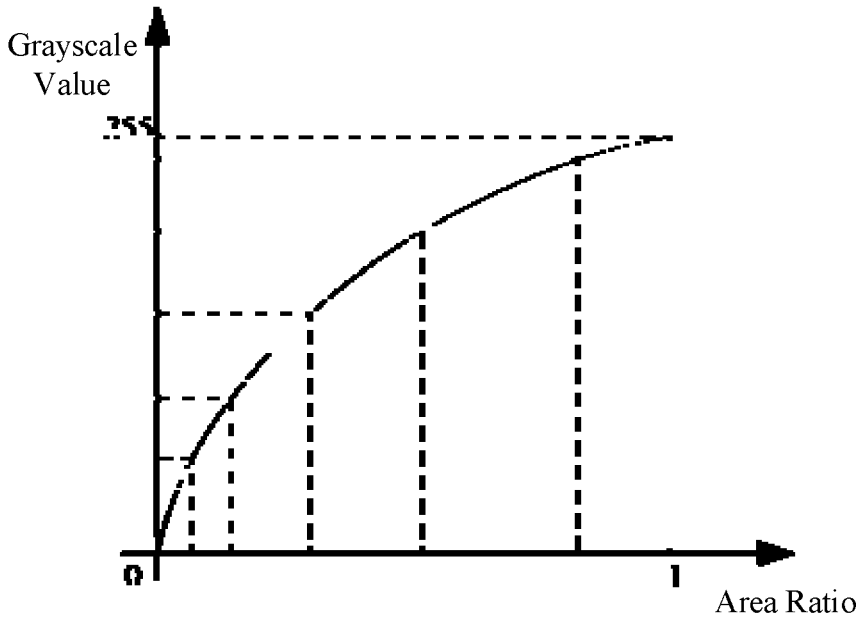
FIG. 7 is a schematic diagram of a function relationship between a grayscale value and an area ratio provided by an embodiment of the present disclosure.

The color of each pixel in an RGB color image is determined by the three components R, G, and B. For a pixel unit, if the color levels of the three components are 8 and the grayscale data is represented by 8 bytes, then as to the pixel units R, G and B of the display panel, for example, each component can have a value of 0 to 255, that is, the 8th power of 2, therefore there are 256 values in total. Then, the corresponding grayscale value ranges from 0 to 255, where 0 represents the darkest, and 255 represents the brightest. For example, in the method of this embodiment, in the case where the light-emitting intensity or transmittance is fixed, if a grayscale value of a complete pixel unit in an irregular-shaped display panel is taken as 255 during display, then on the irregular-shaped display panel, the grayscale value actually displayed by the pixel unit passed by the irregular-shaped edge is related to the area ratio between the area of the display region and the area of the entire pixel unit, and this relationship can also form a gamma curve. Based on the above principle, FIG. 7 shows a schematic diagram of a gamma function relationship between the grayscale value and the area ratio. The abscissa of the gamma function curve is the area ratio calculated according to the above method, and the ordinate is the grayscale value. After the area ratio is calculated, the grayscale value of the pixel unit passed by the irregular-shaped edge can be obtained from the gamma curve according to the area ratio. This grayscale value can be used as the grayscale parameter of the pixel unit, and the pixel unit passed by the irregular-shaped edge can be adjusted in the display grayscale based on the grayscale parameter and perform display operations. For details, please refer to the following description. For example, when the area ratio is 0.1, the corresponding grayscale value obtained from an exemplary gamma curve is 36; for example, this grayscale value can be used as the grayscale parameter of a pixel unit with an area ratio of 0.1.

For example, in order to make the functional relationship between the grayscale value and the area ratio accurate, the gamma value may be determined in advance. For example, the gamma value can be determined to be in the range of 2.0~2.4, for example, 2.2 is selected.

For example, if the gamma value is 2.2, and for a pixel unit passed by the irregular-shaped edge, the area ratio of the area of the display region to the area of the pixel unit is 0.5, the grayscale parameter can be determined as "X=255*transmittance 1/γ", i.e., 255*0.51/2.2≈186. For another example, for a pixel unit passed by the irregular-shaped edge, the area ratio of the area of the display region to the area of the pixel unit is 0.1, and the grayscale parameter can be determined as "X=255*transmittance 1/γ", i.e., 255*0.11/2.2≈90. Therefore, the above grayscale parameters are the same as the grayscale value of the pixel unit when displaying a reference white picture (i.e., the picture of which the grayscale values of the RGB pixels are all 255), that is, when the pixel unit should display a maximum grayscale value of 255, because the non-display region is blocked by the black matrix, the light in this part will not be transmitted, and only the light in the display region can be transmitted. Therefore, the gray scale value actually perceived by the human eye is related to the area ratio of the area of the display region to the area of the pixel unit.

In an example, in the above calculation, in order to simplify the setting of the grayscale values of the pixel units, reduce the amount of data and calculation, the grayscale values of the pixel units are divided into several intervals, and an eigenvalue is set for each interval. All the grayscale values that are above calculated and fall within a certain interval are modified to the eigenvalue of the interval to obtain modified grayscale value (or compensated grayscale values). For example, the range of grayscale values from 0 to 255 can be divided into 8 intervals, and the step size of each interval is 32, that is, the ranges of grayscale values of these intervals are 0 to 31, 32 to 63, . . . , 224~255, respectively. The eigenvalue of each interval can take, for example, the minimum value (e.g., 0, 32, . . . , 224), the maximum value (e.g., 31, 63, . . . , 255), the intermediate value (e.g., 15, 47, . . . , 239), or the like. The following description will take eight intervals as an example, but embodiments of the present disclosure are not limited thereto.

For example, for the case where the grayscale value of the pixel unit calculated by the gamma function relationship is 36, when the minimum value is taken as the eigenvalue of each interval, the grayscale value of the pixel unit is modified to 32, that is, the compensated grayscale value is 32, and the grayscale parameter of the pixel unit is adjusted to 32 accordingly. For another example, for the case where the grayscale value of the pixel unit calculated by the linear function relationship is 90, when the minimum value is taken as the eigenvalue of each interval, the grayscale value of the pixel unit is modified to 64, that is, the compensated grayscale value is 64, and the grayscale parameter of the pixel unit is adjusted to 64 accordingly.

In this way, the grayscale parameters of all the pixel units passed by the irregular-shaped edge each will be one of the eight predetermined grayscale values. Correspondingly, in the following, the blocking ranges of the black matrix to the pixel units passed by the irregular-shaped edge each will be fine-tuned based on one of these eight grayscale values, instead of all 256 possible grayscale values, so that the workload of fine-tuning is significantly reduced, and the grayscale parameters each are also one of eight predetermined values, which reduces the calculation amount of subsequent display operations. The blocking ranges of the black matrix to the pixel units passed by the irregular-shaped edge are fine-tuned, so that the area ratio of the area of the display region of a pixel unit to the area of the pixel unit corresponds to the compensated grayscale value adjusted by the interval method described above. Specifically, a new area ratio is obtained by back-calculating from the gamma function or the linear function according to the compensated grayscale value, and then the display region is reduced based on the new area ratio (corresponding to the case where the eigenvalue is the minimum value), that is, the blocking area of the black matrix is increased, and the manufacturing process of the irregular-shaped display panel is adjusted and determined based on this increase.

For example, after the grayscale parameters of the pixel units passed by the irregular-shaped edge are determined, these grayscale parameters are stored, for example, stored in a look-up table manner, so as to be easily accessed when subsequently the display panel performs display operations. The method of this embodiment can be used in different electronic apparatuses including a memory and a processor, such as a mobile phone, a computer, etc. Therefore, the grayscale parameter can be stored in a specified storage apparatus, such as a ROM (read only memory) of a mobile phone, a hard disk of a computer, and the like, which is not specifically limited in this embodiment.

Figure 8:
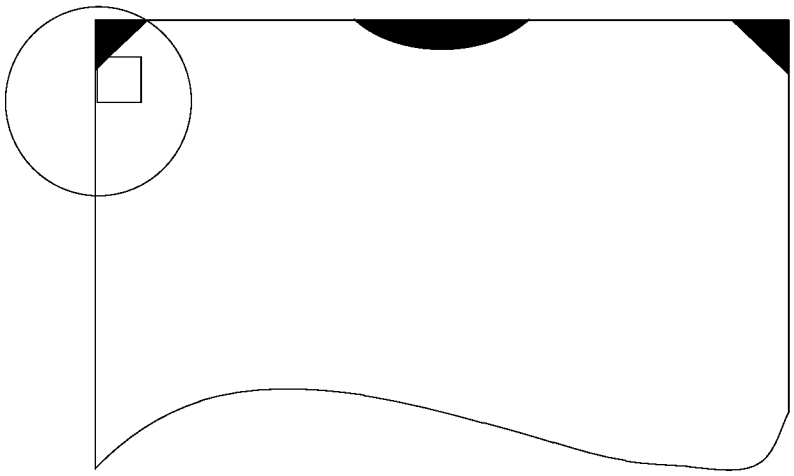
FIG. 8 is a schematic diagram of another case of an irregular-shaped edge provided by an embodiment of the present disclosure.
Figure 9:
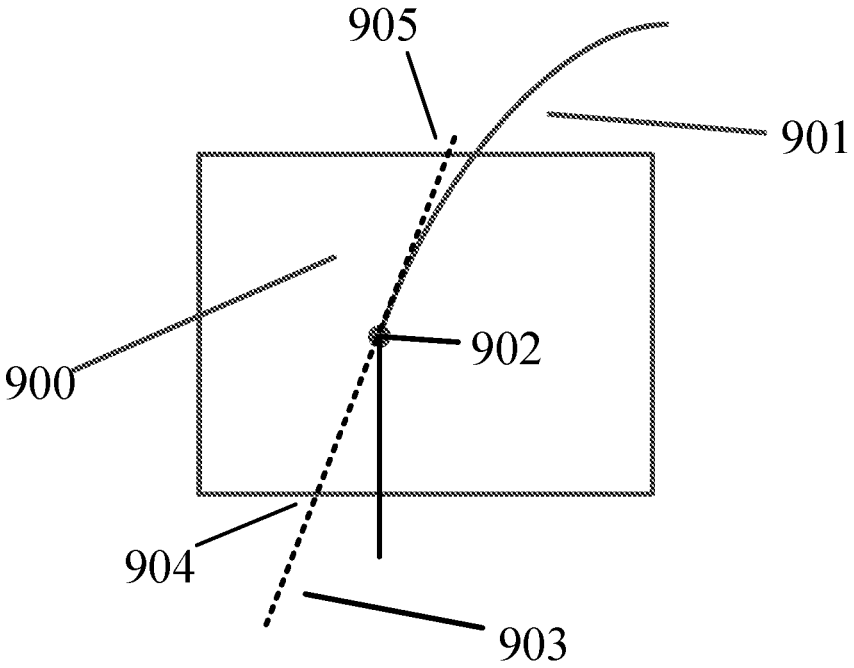
FIG. 9 is a partially enlarged schematic diagram of still another case of an irregular-shaped edge provided by an embodiment of the present disclosure.

For example, in another example of an embodiment of the present disclosure, the irregular-shaped edge is ended inside a certain pixel unit, that is, for this specific pixel unit, the irregular-shaped edge does not completely pass through it. A schematic diagram of this case is shown in FIG. 8. Based on FIG. 8, a schematic diagram of partially enlarging the pixel unit is shown in FIG. 9. In FIG. 9, an irregular-shaped edge 901 is ended inside a pixel unit 900, and the endpoint is the point 902. In this case, an extension line 903 of the irregular-shaped edge can be made through the point 902. The extension line 903 is tangent to the irregular-shaped edge 901, has an intersection 905 with an edge of the pixel unit on one side of the irregular-shaped edge, and has another intersection 904 with an edge of the pixel unit on the other side of the irregular-shaped edge. At this time, the line between the points 904 and 905 on the extension line 903 is used to divide the pixel unit into a display region and a non-display region.

Figure 10:
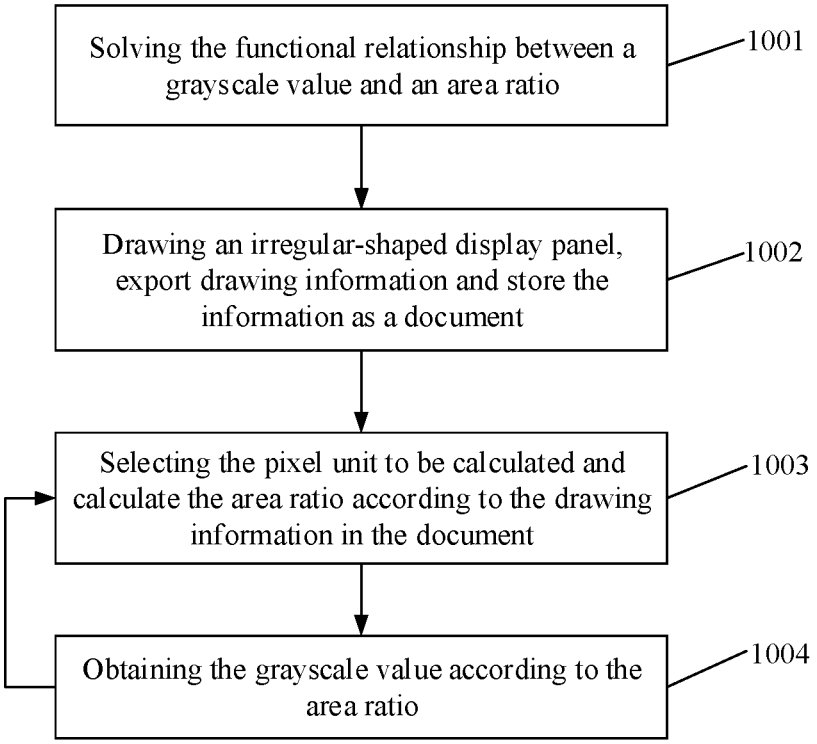
FIG. 10 is a schematic flowchart of a display optimization method provided by an embodiment of the present disclosure.

For example, the above-mentioned display optimization method according to the present disclosure may be implemented in software or the like. The flow chart of the specific implementation process is shown in FIG. 10 and has the following steps S1001 to S1004:

In step S1001, the function relationship between the grayscale value and the area ratio is solved.

According to an embodiment of the above display optimization method, it can be known that, for a pixel unit passed by an irregular-shaped edge, under a condition that a gamma function is determined, the area ratio of the area of the display region to the area of the pixel unit has a corresponding relationship with a grayscale value. Therefore, for example, the gamma function relationship curve of the grayscale value and the area ratio can be obtained by using software, such as MATLAB.

Step S1002: an irregular-shaped display panel is drawn, and the drawing information is exported and stored as a document.

In specific implementations, the irregular-shaped panel can be drawn using a drawing software such as CAD, SolidWorks, and the like. The irregular-shaped display panel may be an irregular-shaped display panel as shown in FIG. 1 or FIG. 4, or may be an irregular-shaped display panel of another shape. In the drawing made by the software, each point of the irregular-shaped display panel has corresponding coordinates, so each part of the irregular-shaped display panel has its corresponding size information and position information. The drawing software has specific operation commands to generate a set of this information and export it, and then store it as a document in a specific format, such as a txt file, for accessing in subsequent steps.

In step S1003, a pixel unit to be calculated is selected, and an area ratio is calculated according to the drawing information in the document.

During the calculation, a specific pixel unit, which is divided into a display region and a non-display region by the irregular-shaped edge, can be selected. The document exported from CAD can be read by a calculation software such as MATLAB to obtain the position information of the intersections between the pixel unit and the irregular edge, thereby calculating the area of the display region of the pixel unit and the area of the pixel unit, and then calculating the area ratio of the area of the display region of the pixel unit passed by the irregular-shaped edge to the area of the pixel unit.

In step S1004, a grayscale value is obtained according to the area ratio, and the process proceeds to step S1003.

After the area ratio of a specific pixel unit is calculated, the grayscale value can be calculated by using MATLAB according to the gamma function curve selected in step S1001. After that, another pixel unit is selected to continue the above calculation steps to finally complete the calculation of the grayscale values of all the pixel units passed by the irregular-shaped edge.

In the example of adjusting the grayscale value in a partitioned manner, after the grayscale value is calculated, the interval in which the calculated grayscale value is located and the eigenvalue of the interval are determined. Then, the calculated grayscale value is modified by the eigenvalue to obtain a compensated grayscale value, a new area ratio of the area of the display region of the pixel unit to the area of the pixel unit is obtained by back-calculating from the gamma function or linear function according to the compensated grayscale value, and the blocking area of the black matrix of the pixel unit is adjusted according to the new area ratio, and is subsequently used in the manufacturing process of the irregular-shaped display panel.

The display optimization method provided by the embodiments of the present disclosure can reasonably set the grayscale parameters of a display panel with an irregular-shaped edge to optimize the display effect thereof.

Another embodiment of the present disclosure provides a display driving method. The driving method includes: determining a grayscale value displayed by a pixel unit passed by an irregular-shaped edge according to a predetermined display grayscale signal and a previously stored grayscale parameter, so that the pixel unit performs display based on the grayscale value. This method can be applicable to the case of the display panel in FIG. 1. The grayscale parameters obtained in this method are generated and stored according to the display optimization method provided by any of the above embodiments. After the grayscale parameters of the pixel units passed by the irregular-shaped edge are obtained, the actual displayed grayscale values can be obtained by performing calculations based on the predetermined display grayscale signals and the grayscale parameters.

For example, for a pixel unit passed by an irregular-shaped edge, according to the display picture, the grayscale value of the display grayscale signal of the pixel unit that is originally input (unprocessed) is 127, and the previously stored grayscale parameter is 32, then the display grayscale value of the pixel unit, which is adjusted according to the highest grayscale value (here, 255), can be determined as $127*(32/255)\approx16$, so the control intensity of the electric signal becomes 0.125 times as before, and thus the pixel unit will actually perform the display operation with the grayscale value of 16. For another example, for a certain pixel unit passed by an irregular-shaped edge, according to the display picture, the grayscale value of the original display grayscale signal of the pixel unit is 127, and the previously stored grayscale parameter is 32. In the current display picture, the pixel unit displays with the grayscale parameter as the grayscale value, that is, the adjusted display grayscale value is 32, then $32/127\approx0.25$, so the control intensity of the electrical signal becomes 0.25 times as before, and thus the pixel unit will actually display the brightness of the grayscale of 32. Of course, the embodiments of the present disclosure are not limited to the above specific calculation method when adjusting the grayscale values of the original display grayscale signals by using the grayscale parameters.

Figure 11:
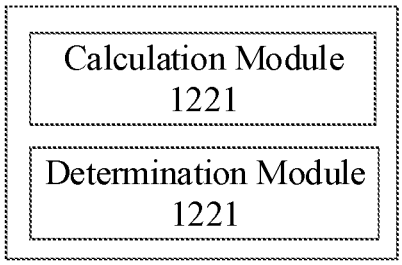
FIG. 11 is a schematic structural diagram of a display optimization apparatus provided by an embodiment of the present disclosure.

Another embodiment of the present disclosure provides a display optimization apparatus. A schematic structural diagram of the display optimization apparatus in this embodiment is shown in FIG. 11. The display optimization apparatus includes: a calculation module 10 for calculating an area ratio of an area of a display region of a pixel unit passed by an irregular-shaped edge to an area of the pixel unit; and a determination module 20 coupled with the calculation module 10 for determining a grayscale parameter of the pixel unit according to the area ratio.

For example, step S201 may be implemented by using the calculation module 10, and the calculation module 10 may be implemented in the form of hardware, software, firmware, or any combination thereof, for example, may be implemented in a circuit or a computer program. For example, step S202 may be implemented by using the determination module 20, and the determination module 20 may be implemented in the form of hardware, software, firmware, or any combination thereof, for example, may be implemented in a circuit or a computer program.

The display optimization apparatus provided by an embodiment of the present disclosure can reasonably set the grayscale parameters of a display panel with an irregular-shaped edge to optimize the display effect.

It should be noted that in the embodiments of the present disclosure, more or fewer modules may be included, and the connection relationship between the modules is not limited and may be determined according to actual requirements. The specific structure of each module is not limited, and it can be composed of an analog apparatus(s) or a digital chip(s) according to the principle of the module, or it can be composed in other applicable ways.

Figure 12:
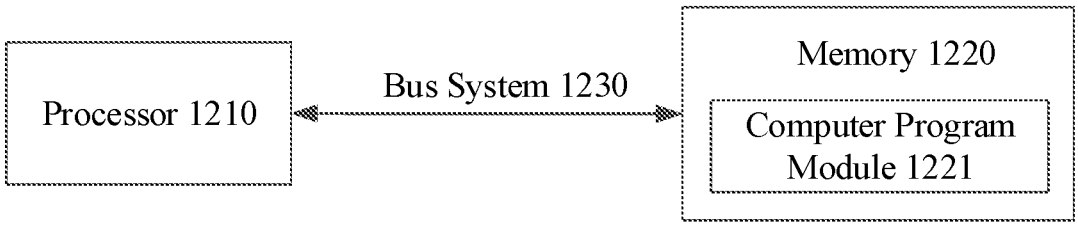
FIG. 12 is a schematic structural diagram of a display optimization apparatus provided by another embodiment of the present disclosure.

Another embodiment of the present disclosure also provides a display optimization apparatus. The structure diagram of the apparatus is shown in FIG. 12. The apparatus includes a processor 1210, a memory 1220, and a bus system 1230.

For example, the processor 1210 and the memory 1220 are connected through a bus system 1230. For example, one or more computer program modules 1221 may be stored in the memory 1220. For example, one or more computer program modules 1221 may include instructions for performing the display optimization method provided by any embodiment of the present disclosure, in order to reasonably set the grayscale parameters of pixel units of a display panel with an irregular-shaped edge. For example, the instructions in one or more computer program modules 1221 may be executed by the processor 1210.

For example, the bus system 1230 may be a commonly used serial or parallel communication bus, and the embodiments of the present disclosure are not limited thereto.

Another embodiment of the present disclosure also provides a display driving apparatus. The display driving apparatus may be used in the display apparatus shown in FIG. 1. The display driving apparatus is coupled to the display panel and is used to drive the display panel to display. The structural diagram of the display driving apparatus is the same as that of the display optimization apparatus, and the display driving apparatus includes a processor, a memory, and a bus system.

For example, the processor and the memory are connected through a bus system. For example, one or more computer program modules may be stored in a memory. For example, one or more computer program modules may include instructions for performing the display driving method provided by any embodiment of the present disclosure, in order to drive a display panel according to the grayscale parameter determined according to the display optimization method provided by any embodiment of the present disclosure. For example, the instructions in one or more computer program modules may be executed by the processor.

In the embodiments of the present disclosure, any processor may be implemented by an application-specific integrated circuit (ASIC) chip, for example, the application-specific integrated circuit chip may be provided on a motherboard, for example, a memory and a power circuit may be provided on the motherboard; the processor may also be implemented in a circuit or in the form of software, hardware (circuit), firmware, or any combination thereof. In the embodiments of the present disclosure, the processor may include various computing structures, such as a complex instruction set computer (CISC) structure, a reduced instruction set computer (RISC) structure, or a structure implementing a combination of multiple instruction sets. In some embodiments, the processor may also be a microprocessor, such as an X86 processor or an ARM processor, or may be a digital processor (DSP) or the like.

In the embodiment of the present disclosure, the memory may be provided on the above motherboard, for example, and the memory may store instructions and/or data executed by the processor. For example, the memory may include one or more computer program products, which may include various forms of computer-readable memory, such as volatile memory and/or non-volatile memory. The volatile memory may include, for example, a random access memory (RAM) and/or a cache memory. The non-volatile memory may include, for example, a read-only memory (ROM), a hard disk, a flash memory, and the like. One or more computer program instructions may be stored on the computer-readable memory, and executed by the processor to implement a desired function (implemented by the processor) in the embodiments of the present disclosure.

An embodiment of the present disclosure also provides a non-volatile storage medium that stores computer-executable instructions that, when executed by a computer, cause the computer to perform the display optimization method provided by any embodiment of the present disclosure, or perform the display driving method provided by any embodiment of the present disclosure.

For example, the storage medium may be any combination of one or more computer-readable storage media. For example, a computer-readable storage medium includes computer-readable program code for calculating an area ratio of an area of a display region of a pixel unit passed by an irregular-shaped edge to an area of the pixel unit. Another computer-readable storage medium includes computer-readable program code for determining a grayscale parameter of the pixel unit according to the area ratio. For example, when the program code is read by a computer, the computer may execute the program code stored in the computer storage medium to perform, for example, the display optimization method provided by any embodiment of the present disclosure.

For example, the storage medium may include a memory card of a smart phone, a storage part of a tablet computer, a hard disk of a personal computer, a random access memory (RAM), a read-only memory (ROM), an erasable programmable read-only memory (EPROM), a compact disc read-only memory (CD-ROM), flash memory, or any combination of the foregoing storage media, or other suitable storage media.

What are described above is related to the illustrative embodiments of the disclosure only and not limitative to the scope of the disclosure; and the scopes of the disclosure are defined by the accompanying claims.

What is claimed is:

1. A display optimization method, comprising:

selecting an irregular-shaped edge of a display panel, and calculating an area ratio of an area of a display region of a pixel unit passed by the irregular-shaped edge and an area of the pixel unit; and determining a grayscale parameter of the pixel unit according to the area ratio, wherein calculating the area ratio of the area of the display region of the pixel unit passed by the irregular-shaped edge to the area of the pixel unit comprises:

connecting two intersections between the irregular-shaped edge and the pixel unit by using a straight line, and dividing the pixel unit into the display region and a non-display region by using the straight line.

2. The display optimization method according to claim 1, wherein the irregular-shaped edge comprises an arc-shaped corner edge or an edge, with a corner formed by straight-lines, of the display panel.

3. The display optimization method according to claim 2, wherein determining the grayscale parameter of the pixel unit according to the area ratio comprises:

obtaining the grayscale parameter from the area ratio according to a predetermined gamma function relationship between a predetermined grayscale value and the area ratio.

4. The display optimization method according to claim 3, wherein obtaining the grayscale parameter from the area ratio according to the predetermined gamma function relationship between the predetermined grayscale value and the area ratio comprises:

dividing a range of grayscale values into multiple intervals, each interval having a corresponding eigenvalue;

obtaining a first grayscale value from the area ratio according to the gamma function relationship, determining a first interval in which the first grayscale value falls, and selecting an eigenvalue of the first interval to modify the first grayscale value, and using a modified first grayscale value as the grayscale parameter.

5. The display optimization method according to claim 1, wherein determining the grayscale parameter of the pixel unit according to the area ratio comprises:

obtaining the grayscale parameter from the area ratio according to a predetermined gamma function relationship between a predetermined grayscale value and the area ratio.

6. The display optimization method according to claim 5, wherein obtaining the grayscale parameter from the area ratio according to the predetermined gamma function relationship between the predetermined grayscale value and the area ratio comprises:

dividing a range of grayscale values into multiple intervals, each interval having a corresponding eigenvalue;

obtaining a first grayscale value from the area ratio according to the gamma function relationship, determining a first interval in which the first grayscale value falls, and selecting an eigenvalue of the first interval to modify the first grayscale value, and using a modified first grayscale value as the grayscale parameter.

7. The display optimization method according to claim 6, further comprising:

obtaining a modified area ratio from the modified first grayscale value according to the gamma function relationship, wherein the modified area ratio is used to adjust the area of the display region of the pixel unit.

8. The display optimization method according to claim 1, further comprising:

storing the grayscale parameter for accessing when the display panel performs a display operation.

9. A display optimization apparatus, comprising:

a processor; and a memory on which computer-executable instructions are stored, wherein the computer-executable instructions, when executed by the processor, cause the processor to perform the display optimization method according to claim 1.

10. A non-transitory storage medium storing computer-executable instructions that, when executed by a computer, cause the computer to perform the display optimization method according to claim 1.

11. A display optimization apparatus, comprising:

a calculation module configured to calculate an area ratio between an area of a display region of a pixel unit passed by an irregular-shaped edge and an area of the pixel unit; and a determination module configured to determine a grayscale parameter of the pixel unit according to the area ratio, wherein the calculation module is further configured to connect two intersections between the irregular-shaped edge and the pixel unit by using a straight line, and divide the pixel unit into the display region and a non-display region by using the straight line.

12. A display driving method, comprising:

determining a display grayscale value displayed by a pixel unit passed by an irregular-shaped edge according to a predetermined display grayscale signal and a previously stored grayscale parameter, so that the pixel unit displays according to the display grayscale value, wherein the grayscale parameter is determined according to the display optimization method according to claim 1.

13. The display driving method according to claim 12, wherein the display grayscale value is obtained by calculating the predetermined display grayscale signal and the grayscale parameter.

14. A display driving apparatus, comprising:

a processor;

a memory on which computer-executable instructions are stored, wherein the computer-executable instructions, when executed by the processor, cause the processor to perform the display driving method according to claim 12.

15. A display apparatus comprising a display panel and the display driving apparatus according to claim 14, wherein the display panel has an irregular-shaped edge, and the display driving apparatus is coupled to the display panel and is configured to drive the display panel.

16. A non-transitory storage medium storing computer-executable instructions that, when executed by a computer, cause the computer to perform the display driving method according to claim 12.

* * * * *